United States Patent [19]

Yoshiura et al.

[11] Patent Number: 4,669,863

[45] Date of Patent: Jun. 2, 1987

[54] COPYING APPARATUS PROVIDED WITH PAPER SIZE MEMORY FUNCTION

[75] Inventors: Shoichiro Yoshiura; Haruyoshi Ikeda, both of Yamatokoriyama, Japan

[73] Assignee: Sharp Kabushiki Kaisha, Osaka, Japan

[21] Appl. No.: 741,853

[22] Filed: Jun. 6, 1985

[30] Foreign Application Priority Data

Jun. 11, 1984 [JP] Japan ..... 59-121005

[51] Int. Cl.[4] ..... G03G 21/00; G03G 15/00

[52] U.S. Cl. ..... 355/14 SH; 355/3 SH; 355/55

[58] Field of Search ..... 355/3 R, 3 SH, 14 R, 355/14 SH, 55

[56] References Cited

U.S. PATENT DOCUMENTS 4,505,579 3/1985 Furuichi ..... 355/14 R X

*Primary Examiner*—Fred L. Braun

*Attorney, Agent, or Firm*—Birch, Stewart, Kolasch & Birch

[57] ABSTRACT

A copying apparatus provided with a paper size memory function. By causing the copying apparatus having the magnification converting function to memorize indefinite shapes of paper sizes so as to readily read out the memorized sizes depending on necessity, overlapping of complicated input operations is omitted in the paper size memory function. Working efficiency of the copying apparatus is improved and the copying apparatus is capable of effectively utilizing the magnification converting function.

5 Claims, 6 Drawing Figures

COPYING APPARATUS PROVIDED WITH PAPER SIZE MEMORY FUNCTION

BACKGROUND OF THE INVENTION

The present invention generally relates to a copying apparatus arranged to read out a preliminarily memorized original paper size from a memory and to calculate a converted magnification for effecting a copying operation at the converted magnification and more particularly, to a copying apparatus provided with a paper size memory function having a device for storing an indefinite shape paper size in a memory and a device for reading out the stored indefinite shape paper size, which are provided at an operating section of the copying apparatus.

In a copying apparatus provided with a function for copying an original document onto copy paper sheets of different paper sizes through conversion of magnifications by altering a lens position or paper feeding speed, it is necessary to set the converted magnification for causing the magnification converting copying function to be effected properly.

In the conventional copying apparatus of this kind, as means for setting the converted magnification, there are provided a memory unit storing therein a plurality of definite shape paper sizes and a sensor for detecting the paper size or a key for selecting the paper size, and a device for reading the paper sizes of the original document and copy paper sheet detected by the sensor or selected by the key, out of the memory so as to calculate a ratio therebetween.

However, in the known technique as described above, for subjecting an original document of an indefinite paper size to the converted magnification copying, a long period of time is required for the detection of the paper size by a sensor provided at the lower portion of an original document platform or for inputting lengths of longitudinal and lateral sides of the paper size by the key provided on the operating section. The procedures are extremely troublesome in the method for inputting the paper size by keys. Meanwhile, in the case where indefinite shape original documents of the same size are frequently copied, it is necessary to input the paper size each time, thus requiring complicated operations, with a marked reduction of the working efficiency for the copying apparatus. Moreover, none of the known copying apparatuses are provided with a device for detecting or inputting sizes of indefinite shape copy paper sheets, and as a matter of fact, it has been impossible to effect copying on the indefinite shape copy paper sheets, and therefore, the variable magnification copying function can not be effectively utilized.

SUMMARY OF THE INVENTION

Accordingly, an essential object of the present invention is to provide an improved copying apparatus provided with a paper size memory function, which is so arranged that, by causing the copying apparatus having the magnification converting function to memorize indefinite shape original paper sizes so as to readily read out the memorized sizes depending on necessity, overlapping of complicated input operations is omitted for improved working efficiency of the copying apparatus. This arrangement results in a copying apparatus capable of effectively utilizing the magnification converting function.

Another important object of the present invention is to provide a copying apparatus of the above described type which is simple in construction and stable in operation, and can be readily manufactured at low cost.

In accomplishing these and other objects, according to one preferred embodiment of the present invention, there is provided a copying apparatus provided with a paper size memory function, arranged to store copy paper sheet sizes in a memory and to read out paper sizes of original documents to be copied and copy paper sheets from the memory so as to calculate converted magnification by a calculating means for effecting the converted magnification copying according to the converted magnification thus calculated, and characterized in that there are provided means for storing lengths of longitudinal sides and lateral sides of indefinite shape paper sizes in the memory, and means for reading out the indefinite shape paper sizes stored in the memory so as to be inputted into the calculating means as the paper size of the original document or copy paper sheet, and a key means provided at an operating section of the copying apparatus for causing said respective means to function.

By the arrangement according to the present invention as described above, in the case where the converted magnification copying is effected through employment of original documents or copy paper sheets of indefinite shape paper size which are frequently used, it becomes possible to omit the operation for the paper size input after a second time, and moreover, since the memorized indefinite shape paper size may be inputted as the size for either one of the original document to be copied or the copy paper sheet, the apparatus may be utilized for copying at an equal size or life size magnification in which the converted magnification is 1:1. Therefore, the copying operation is simplified and working time is reduced, with an improvement of the operating efficiency of the copying apparatus, and consequently, the converted magnification copying function may be effectively utilized.

Further scope of applicabitlity of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1A:
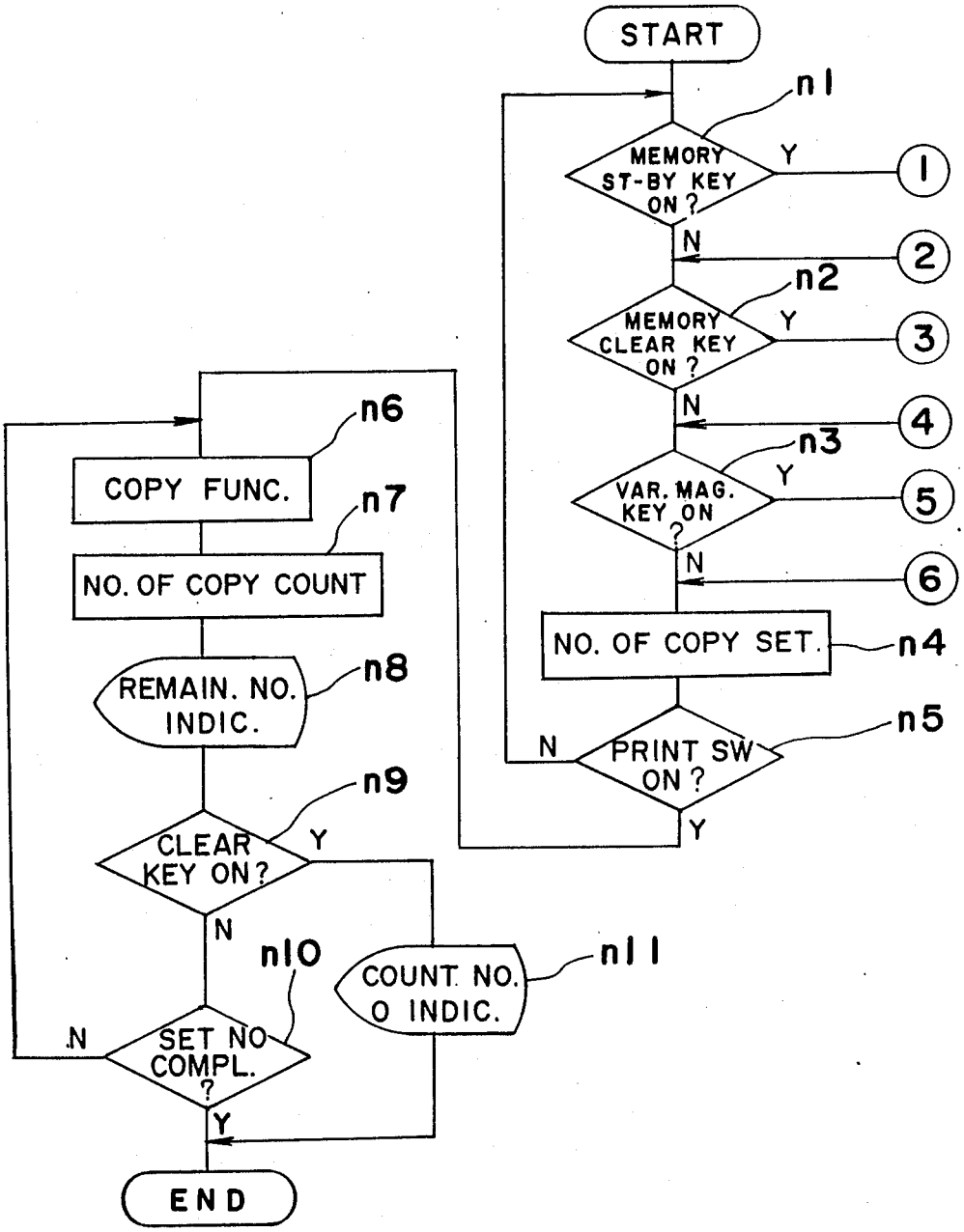
FIGS. 1 (A) through 1(D) are flow-charts for explaining functions of a copying apparatus provided with a paper size memory function according to one preferred embodiment of the present invention.
Figure 1:
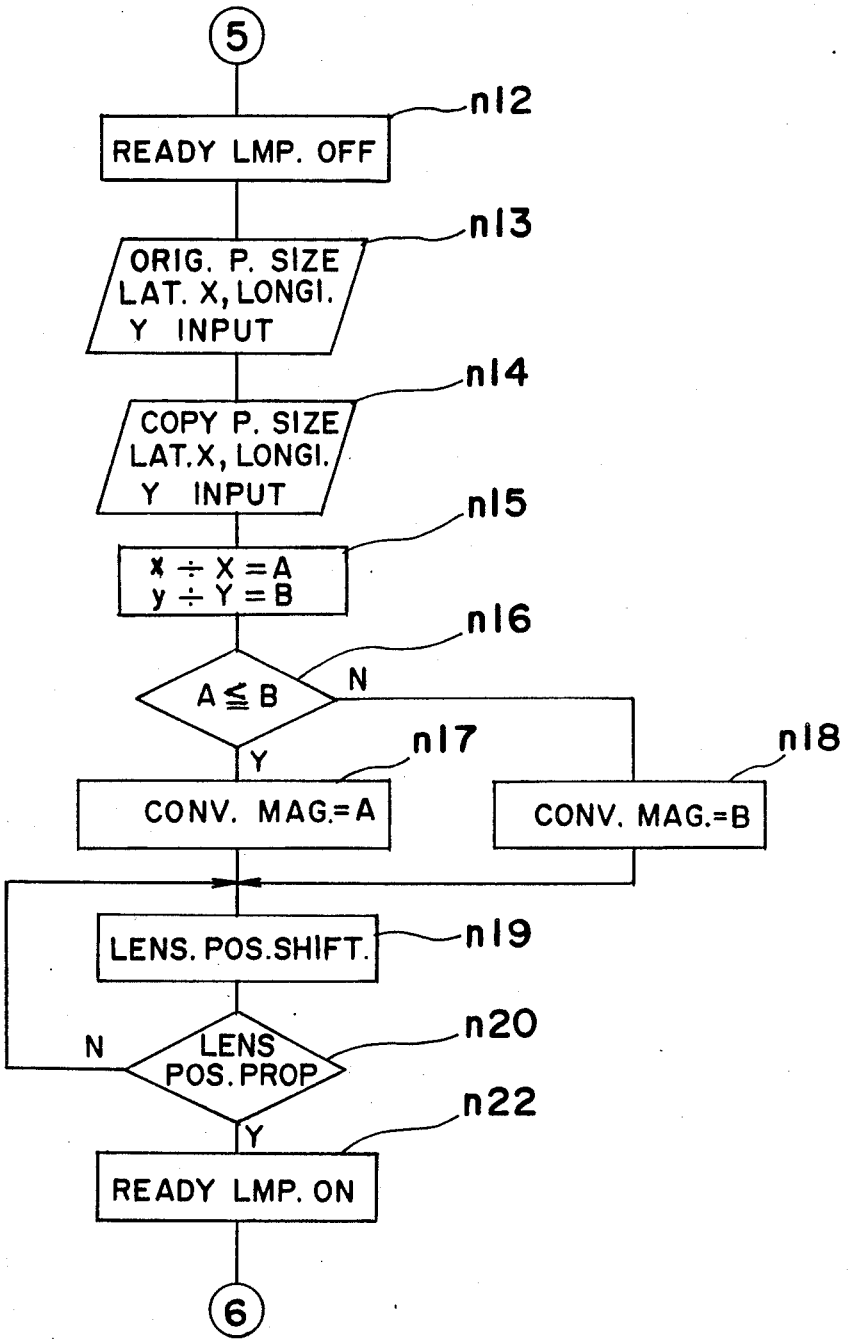
Figure 1:
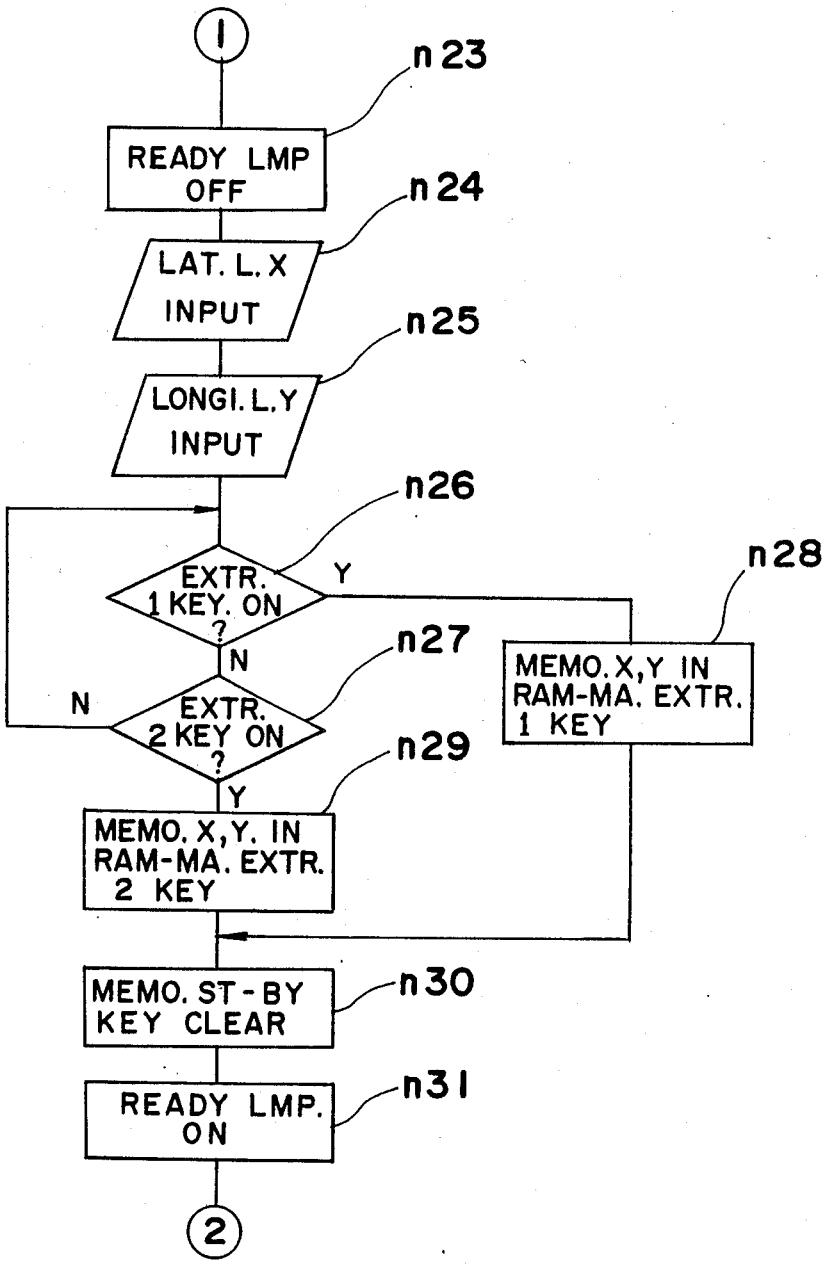
Figure 1:
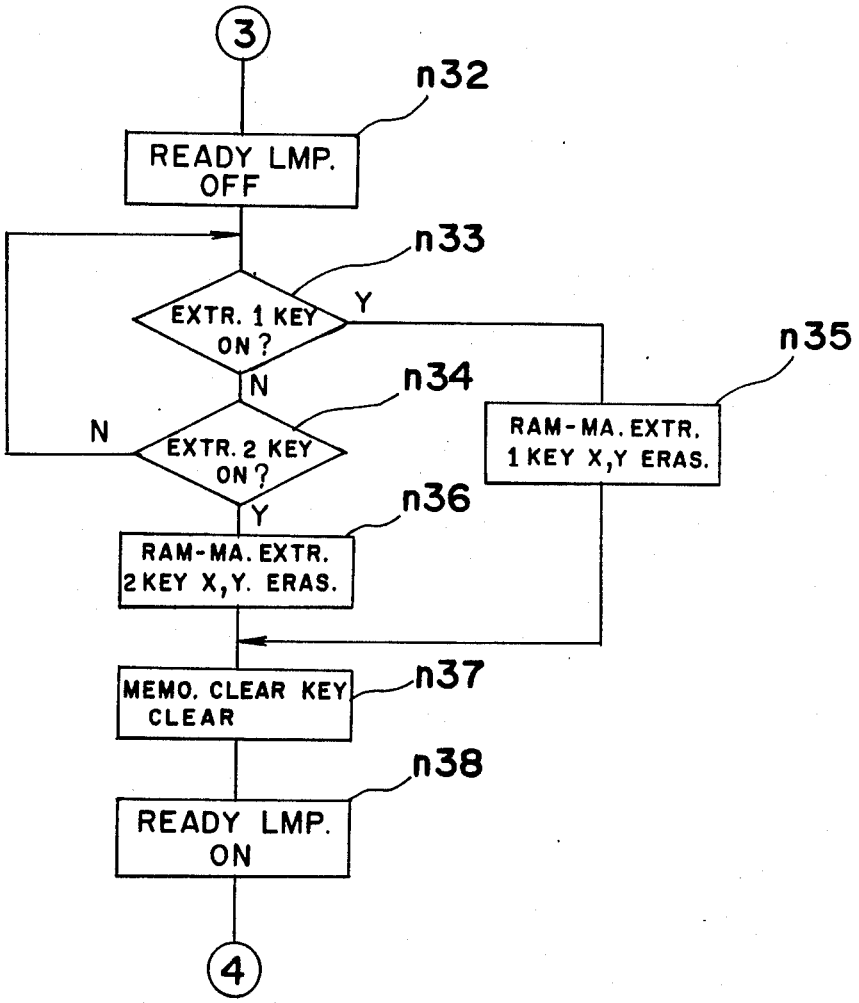

Before the description of the present invention proceeds, it is to be noted that like parts are designated by like reference numerals throughout the accompanying drawings.

Figure 2:
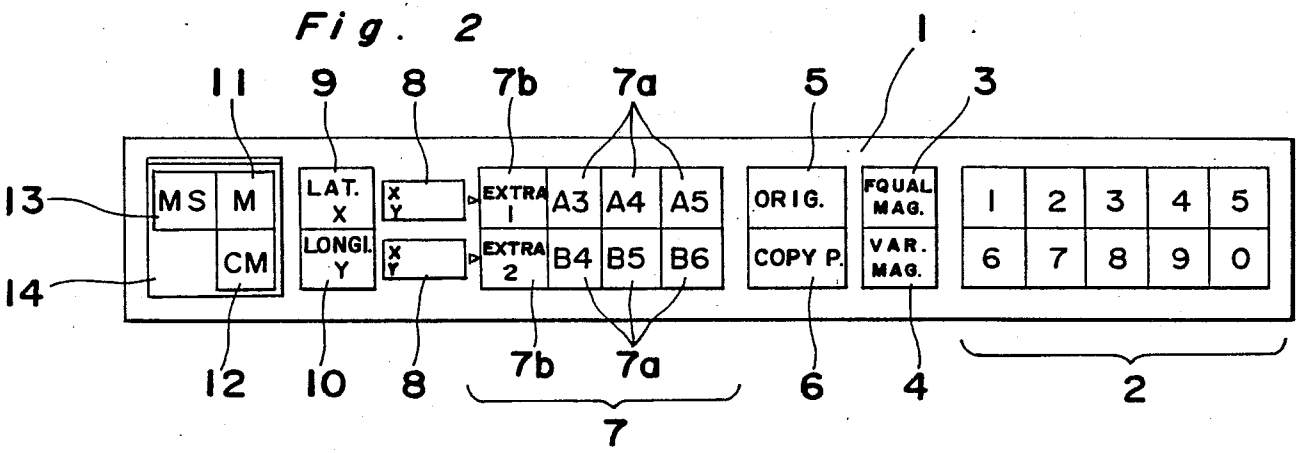
FIG. 2 is a fragmentary front elevational view of an operating section for the copying apparatus of FIG. 1.

Referring now to the drawings, there is shown in FIG. 2 the main portion of an operating section or control panel 1 of a copying apparatus provided with a paper size memory function according to one preferred embodiment of the present invention.

In FIG. 2, the operating section 1 has ten-keys 2 arranged at its right side end portion, and numerical values by the ten-keys 2 as operated are displayed on a display unit (not shown) as the number of copies to be taken or lengths of longitudinal and lateral sides of the indefinite shape paper sheets. At the left side of the ten-keys 2, there are provided an equal size magnification selecting key 3 for effecting the equal size magnification or life size copying, and a variable magnification selecting key 4 operated when copying is effected at varied magnifications. Further provided at the left of the keys 3 and 4 are an original document size setting key 5 to be operated when the paper size as selected by paper size selecting keys 7 (to be mentioned later) is the size of the original document, and a paper size setting key 6 to be actuated when said paper size is the size of the copy paper sheet. The paper size selecting keys 7 include six kinds of definite shape size (or standard size) selecting keys 7*a* corresponding to all paper sizes which can be employed for this copying apparatus and two extra keys 7*b*, so that for inputting paper sizes of the difinite shape original documents or standard size copy paper sheets, the definite shape size selecting key 7*a* is operated, while the indefinite shape paper sizes (or other paper sizes) are stored in the memory or read out from the memory through the extra key 7*b* and the ten-keys 2 and the memory key 11 (to be described later) so as to be inputted into a calculating means. At the left side of the extra keys 7*b*, memory content display units 8 are provided for indicating the contents memorized by the extra keys 7*b*. Moreover, at the left of the display units 8, a lateral side designation key 9 and a longitudinal side designation key 10 are provided for designating whether the numerical values obtained by the operation of the ten-keys 2 are related to the lateral side or longitudinal side of the paper size during memorizing of the indefinite shape paper size. Furthermore, at the left side of the designation keys 9 and 10, there are disposed a memory stand-by key 13 and a memory key 11 to be operated for memorizing the indefinite shape paper size, and also, a memory clear key 12 to be operated for erasing the stored contents, while a cover 14 is applied to the surfaces of the keys 11, 12 and 13 for prevention of erroneous operations.

For storing the size of indefinite shape paper copy sheets (i.e. the other copy sheets) in the memory, the memory stand-by key 13 is first operated, and then, the numerical value for the lateral side size is inputted by the ten-keys 2, with simultaneous operation of the lateral side designation key 9. Subsequently, the numerical value for the longitudinal side size is inputted by the ten-keys 2 to operate the longitudinal side designation key 10. The operation for the input may be started from any of the longitudinal or lateral sides in order. Thereafter, when either of the indefinite shape size keys 7*b* is actuated, the inputted numerical values of the respective sides are displayed on the memory content display unit 8 corresponding to the actuated key 7*b*, and upon final operation of the memory key 11, the inputted numerical values are stored in the memory. For calling out the stored paper size, the extra key 7*b* is actuated after operation of either one of the original document size setting key 5 or copy paper sheet size setting key 6. Meanwhile, when copying is effected through employment of an indefinite shape size original document or copy paper sheet whose paper size is not required to be memorized, either one of the designation key 9 or 10 is actuated after operation of either one of the setting key 5 or 6, and the numerical value is inputted by the ten-keys 2. In the operating section 1 as described so far, the extra keys 7*b* and the keys 11 to 13 related to the memory operation are the keys for causing to function, the means for memorizing and reading out the paper sizes according to the present invention.

Figure 3:
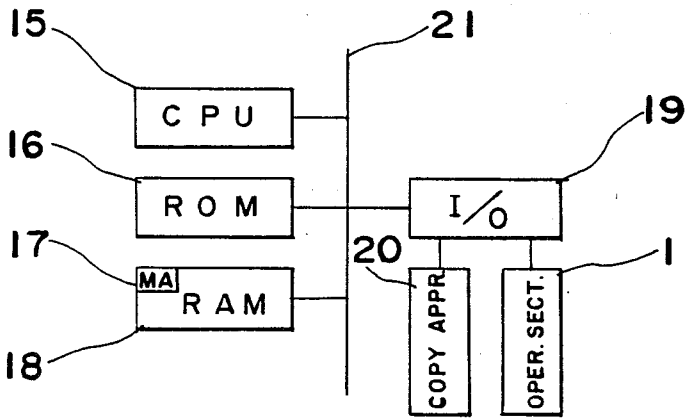
FIG. 3 is a schematic block diagram explanatory of a general construction of the copying apparatus of FIG. 1.

Reference is also made to FIG. 3 showing a block diagram for the copying apparatus provided with the paper size memory function according to the present invention.

In FIG. 3, a ROM (read only memory) 16 for regulating functioning of a CPU (central processing unit) 15, an I/0 (input/output) interface 19 to which the copying apparatus 20 and operating section 1 are connected, and a RAM (random access memory) 18 for storing data from the I/0 interface 19 are coupled with the CPU 15 through an internal bus 21. At a portion MA of the RAM 18, a paper size memory area 17 for storing the paper size is provided so as to have regions corresponding to the respective two extra keys 7*b*.

Referring further to FIGS. 1(A) through 1(D), there are shown flow-charts for explaining functionings of the copying apparatus having the paper size memory function according to the present invention.

At steps n1 and n2, it is determined whether or not the memory stand-by key 13 or memory clear key 12 is operated. If neither of the keys 13 and 12 is operated, judgement is made, at step n3, as to whether or not the converted magnification copying is selected, and here, if the equal size magnification selecting key 3 has been operated, the procedure proceeds to step n4, and when the number of copies to be taken is set by the ten-keys 2 and the print switch is operated at step n5, the copying function is effected at steps n6 through n11. If the memory stand-by key 13 has been operated at step n1, the procedure is shifted to step n23 (FIG. 1(C)) to turn off a ready lamp which indicates whether or not the start button can be operated, and at steps n24 and n25, the lateral side length X and longitudinal side length Y are inputted according to the memory input method described earlier. Thereafter, at steps n26 and n27, either one of the extra keys 7*b* is operated, and the paper size is stored in either one of the regions in the memory area 17 of the RAM 18 at steps n28 and n29. The memory stand-by key 13 is cleared at step n30 so as to return to the ready state at step n31 for reverting back to step n2. In the case where the memory clear key 12 is operated at step n2, the procedure proceeds to step n32, to turn off the ready lamp (FIG. 1(D)). At step n33 or n34, it is judged whether or not either one of the extra keys 7*b* is operated, and at step n35 or n36, the paper size stored in the operated region in the memory area 17 is erased. Subsequently, at step n37, the memory clear key 12 is cleared, and then, the ready lamp is lit at step n38 to return to step n3. At step n3, if the variable magnification selecting key 4 is operated, the procedure proceeds to step n12 and the ready lamp is turned off (Fig. 1(B)). At step n13, the paper size of the original document is inputted by the paper size selecting key 7 and the original document size setting key 5, while at step n14, the copy paper sheet size is applied by the paper size selecting key 7 and paper size setting key 6. In the case where the paper size selecting key 7 operated at steps n13 and n14 is the extra key 7*b*, the paper size stored in the memory area 17 is read out. Subsequently, at step n15, ratios A and B of lateral sides X and longitudinal sides Y of the original document and copy paper sheet are computed by the calculating means. At steps n16 to n18, the ratio having the smaller numerical value is selected as the converted magnification, and at steps n19 and n20, the lens is shifted to the position corresponding to this converted magnification, and thus, at step n22, the ready lamp is lit, with the procedure reverting to step n4.

As is clear from the foregoing description, according to the copying apparatus of the present invention, the copying operation is simplified, with a reduction of working time, and the operating efficiency of the copying apparatus is markedly improved.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A copying apparatus for copying original documents during a copying operation onto at least one of a plurality of standard shape copy sheets and a plurality of other copy sheets having sizes different from said standard sheets, said copying apparatus comprising:

memory means for storing sizes of said standard shape copy sheets and selected ones of said other copy sheets;

calculating means for calculating magnifications for the copying operation;

read out means for reading out at least one of the sizes stored in said memory means to said calculating means during the copying operation;

input means for selectively inputting the sizes of said other copy sheets into at least one of said memory means and said calculating means, said size input into said memory means selectively remaining therein during subsequent copying operations, said size input into said calculating means remaining therein only for the present copying operation;

selector means for selecting the type of final copy sheet onto which the original document will be copied, said type of final copy sheet being one of either the standard shape copy sheets or the other copy sheets; and control means responsive to said memory means, said calculating means, and said selector means, said control means forming the image of the original document on said final copy sheet based on the type of sheet selected by the selector means and based on the size of the final copy sheet from either the memory means or the calculating means.

2. The copying apparatus of claim 1, wherein said input means comprises keys located at an operation station, said keys permitting the input of a length of a longitudinal side and a length of a lateral side of said other copy sheet, said lengths determining the size of the other copy sheet.

3. The copying apparatus of claim 1, further comprising means for selecting variable magnification, said input means additionally, selectively inputting the size of the original document to be copied into said calculating means, said calculating means determining the ratio of the inputted size of the original document to the size of the final copy sheet, said calculating means using said ratio to determine converted magnification when said means for selecting variable magnification is actuated, said control means permitting accurate copying of the original by use of the converted magnification after said means for selecting variable magnification is actuated 4. The copying apparatus of claim 1 further comprising means for selectively erasing the other copy sheet sizes stored in said memory means.

5. The copying apparatus of claim 1, wherein said memory means is a memory area provided at a portion of a random access memory of a micro-computer.

* * * * *